United States Patent [19]

Scherzer

[11] 4,039,886

[45] Aug. 2, 1977

[54] CONTACT PIN INSULATION OF INFRARED BRIGHT RADIATORS

[75] Inventor: Joachim Scherzer, Bruchkobel, Germany

[73] Assignee: Original Hanau Quarzlampen, Hanau am Main, Germany

[21] Appl. No.: 717,823

[22] Filed: Aug. 26, 1976

[30] Foreign Application Priority Data

Sept. 4, 1975 Germany ..... 2539459

[51] Int. Cl.[2] ..... H01K 5/02; H01K 1/46; H05B 3/40; H01J 5/50

[52] U.S. Cl. ..... 313/318; 174/138 F; 313/331; 338/237; 339/145 D

[58] Field of Search ..... 174/50.52, 50.59, 50.64, 174/74 A, 138 F; 219/553; 313/51, 315, 318, 331; 339/59 R, 59 L, 144 R, 144 T, 145 R, 145 D, 145 T, 213 R, 213 T, 217 R; 338/236, 237

[56] References Cited

U.S. PATENT DOCUMENTS

| | | | |
|---|---|---|---|
| 3,001,096 | 9/1961 | Mosby | 313/318 |
| 3,346,768 | 10/1967 | Patsch | 313/318 X |

*Primary Examiner*—Laramie E. Askin

*Attorney, Agent, or Firm*—Sughrue, Rothwell, Mion, Zinn and Macpeak

[57] ABSTRACT

Contact pins are mechanically fixed to hollow cylindrical insulation sleeves surrounding the contact pins at both ends of an infrared bright radiator by way of a circumferential recess within the inner wall of the hollow cylindrical sleeve or the opposed surface of the contact pin which receives a radial projection carried by the other of the two members to limit axial movement of the pin relative to the insulation sleeve.

9 Claims, 5 Drawing Figures

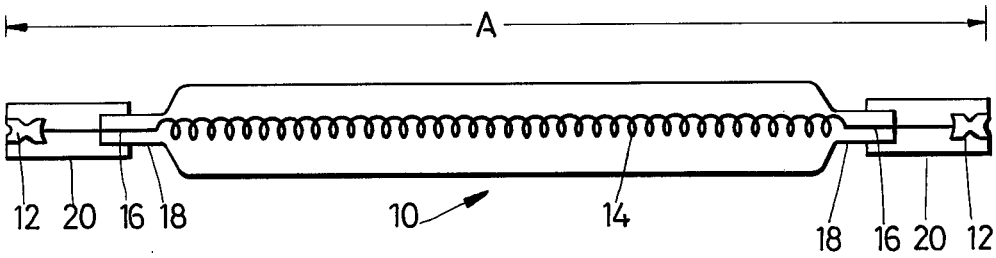
(PRIOR ART) Fig.1
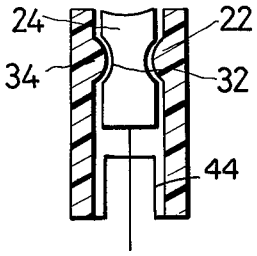
Fig.2
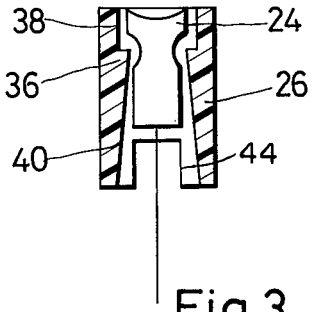
Fig.3
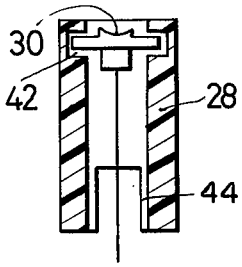
Fig.4
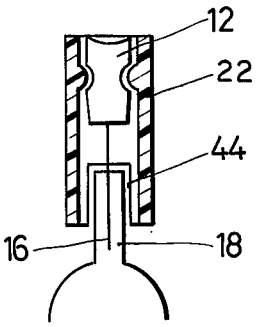
Fig.5

CONTACT PIN INSULATION OF INFRARED BRIGHT RADIATORS

BACKGROUND OF THE INVENTION

1. Field of the Invention

This invention relates to the mounting of contact pins within insulation sleeves carried on the ends of an infrared bright radiator.

2. Description of the Prior Art

Such infrared bright radiators conventionally employ a hollow cylinder of insulation material having at least its outside circumferential surface level and being provided with two diametrically opposite slits at the end of the sleeve remote from the free end of the contact pin axially mounted within the hollow insulation cylinder. Such radiators are set forth in U.S. Pat. No. 3,864,598.

In order to insulate the contact pins which project from the infrared bright radiators at both ends, which can be endowed with halides and preferably are used for photoreproduction purposes, one normally employs ceramic sleeves which are cemented into the ends of the contact pin. This method consumes much time and involves a high labor cost since the sleeve must at first be cemented and subsequently the distance between the sleeve ends of the radiator must be fixed by mounting the assembly in a jig, and finally the cement must be cured by storing the assembly and jig in a drying stove. Although the distance between the sleeve ends is largely predetermined by the sleeve slits which engage the pinch ends of the radiator, this predimensioning is not sufficient, since during the curing process the sleeves are axially displaced due to the expansion of the cement, and the exact adaptation of the brittle ceramic material to the pinched ends of the radiator is not possible.

It is therefore an object of the present invention to provide an insulation for the contact pins of such infrared bright radiators which may be effected in a simple manner with little expense and which is fixed to the contact pin and surrounds the same, thereby dispensing the necessity of use of a cement and maintaining the proper distance between the ends of the insulating sleeves at a selected dimension by the aid of a jig or the like.

SUMMARY OF THE INVENTION

In accordance with the invention, the problem is solved in that the inner surface of the insulating sleeve, which sleeve is formed of plastic material, is provided with an annular recess or a radial protrusion for fixedly locking the sleeve to the contact pin which in turn carries on its outer periphery a mating radial projection or recess. A firm lock or catch is thus achieved such that the distance between the sleeve ends of the radiator can be positively determined and the dimensioning of the distance between the sleeve ends of the radiator can be achieved without the aid or necessity of a jig, and the cementing and subsequent curing of the cement may be avoided. By eliminating these manufacturing steps, the time for manufacture of an infrared bright radiator is reduced. The fitting of the base of the radiator alone reduces the work to one-half that as compared to radiators with conventional insulating sleeves.

Preferably, the inner surface of the insulating sleeve may have a radial protrusion, for example in the form of a bead, for engaging an annular groove on the contact pin. The protrusion can also constitute a projection being formed by a transition from a cylindrical recess to a truncated cone-shaped recess, whereby the diameter of the cylindrical recess at the transition point to the truncated cone-shaped recess is greater than the diameter of the adjacent truncated cone-shaped recess. Thereby, the truncated cone-shaped recess may be enlarged in a direction towards that end face of the insulating sleeve which projects away from the free end of the contact pin.

In another embodiment of the invention, the recess within the insulating sleeve which clasps the contact pin takes the form of a cylindrical disc as is normally used in connection with ceramic sleeves, and may constitute a fitted annular groove.

To additionally secure the ends of the insulating sleeves which face each other, the slits may be configured in the form of a rectangle and have a length which corresponds to the length of the pinched ends of the radiator.

The insulating sleeve may be a die-cast part formed of synthetic material with good insulating properties and a low coefficient of expansion in the temperature range of room temperature to approximately 260° C. Preferably, the synthetic material is a PFA-fluorine synthetic material, thus a copolymer, possessing the carbon-fluorine-main chain of fluorine synthetic material and perfluorakoxy side chains.

Examples of embodiments of the invention will be apparent upon consideration of the following description in conjunction with the annexed drawings.

BRIEF DESCRIPTION OF THE DRAWINGS

FIG. 1 is a schematic view of an infrared bright radiator of prior art construction with insulating sleeves arranged on contact pins.

FIG. 2 is a sectional view of a first embodiment of the present invention illustrating an insulating sleeve surrounding a contact pin.

FIG. 3 is a sectional view of a second embodiment of the present invention showing an insulating sleeve surrounding a contact pin.

FIG. 4 is a sectional view of yet a third embodiment of the present invention.

FIG.5 is a sectional side view of an embodiment of the invention illustrating the slits within the insulating sleeve.

DESCRIPTION OF THE PREFERRED EMBODIMENT

FIG. 1 schematically represents a prior art construction of an infrared bright radiator to which the present invention has application, the radiator 10 being of the type endowed with halides. Between two contact pins 12 which are provided on the ends of the radiator 10, preferably consisting of quartz, there is arranged a glow filament 14. The contact pins 12 are connected to the glow filament 14 at respective ends by metal sealing foil 16 each being located within the pinched end 18 of the radiator 10, at respective ends.

The construction thus illustrated is conventional.

FIGS. 2, 3 and 4 constitute enlarged sectional views of the insulating sleeves and the contact pin assemblies forming multiple embodiments of the present invention. In FIG. 2, insulating sleeve 22 is firmly caught or locked to the contact pin 24 which is in high contrast to FIG. 1 in which the contact pin 12 is of conventional construction mounted to a conventional insulating sleeve 20 permitting the radiator 10 to be installed in a photocopying apparatus, for example.

The contact pin 24 in accordance with FIG. 2 is cylindrical in form and presents an annular groove 32 on its periphery which engages an annular head 34 constituting a radial projection on the inner surface of the cylindrical insulating sleeve 22 in order that the sleeve be tightly connected to the contact pin 24 and thus to the infrared bright radiator 10 to which the sleeve is mounted. The insulting sleeve 22 is a die-cast part and apart from bead 34 consists of a hollow cylinder provided with two slits 44 which are diametrically opposite on its end face which faces away from the end of the contact pin, as shown in greater detail in FIG. 5.

The contact pin 24 in accordance with FIG. 3 corresponds to the same contact pin in FIG. 2, but in this case the insulating sleeve 26 is configured differently. The insulating sleeve 26 is configured as a hollow cylinder with a level or even outer surface but has a projection 36 on its inner surface defined by the transition from a cylindrical recess 38 to a truncated cone-shaped recess 40 which acts as an extension thereof within the insulatng sleeve 26. The projection 36 accomplishes the same function as the annular bead 34 of sleeve 22 and engages the annular groove 32 of contact pin 24 to axially lock or locate the sleeve on the pin.

By reference to FIG. 4, it is seen that the contact pin 30 corresponds to the pin 12 of the infrared bright radiator 10 used for insulation with ceramic sleeves. The contact pin 30 is configured as a cylindrical disc with a joining piece of smaller diameter and is connected to a metal sealing foil 16 at the pinched end 18 of radiator 10 via connecting wire. In order that the insulating sleeve 28 can tightly surround the contact pin, an annular groove 42 which receives the contact pin 30, is provided within the insulatng sleeve 28 which is constituted as a hollow cylinder.

Like the insulating sleeves 22 and 26, the sleeve 28 is also a die-cast part and preferably is made of PFA-fluor synthetic material. Due to the plastic property of this synthetic material, there is no difficulty at all in forcing the insulating sleeves 22, 26 and 28 over the various contact pins 24 and 30 of the illustrated embodiments.

In order to simplify this operation, the internal diameters of the insulatng sleeves 22 and 28 may be enlarged in the direction of the quartz walls of the infrared bright radiator 10. That is, the diameter may be expanded to permit relative insertion of the contact pins axially into the cylindrical sleeves.

In order to guarantee a safe mounting of the infrared bright radiators, the distance between the free ends of the insulating sleeves 20, 22, 26, and 28 surrounding contact pins 12, 24, and 30 respectively, must have only small tolerances. By the cooperation of projections 34, 36, or the recess 42 of the insulating sleeves 22, 26, and 28 respectively, with the annular groove 32 of the contact pin 24 or, respectively, the cylindrical contact pin 30, there is always the guarantee that the required distance A for the total length of the infrared bright radiator 10 not exceed a present tolerance. In addition to this setting of the distance, there are two slits 44 diametrically oppositely arranged on the lateral surfaces of the insulating sleeves 22, 26, 28, which are rectangularly configured and surround the pinched ends 18 of the infrared bright radiator 10. The length of the slits 44 is selected in such a manner that the slits 44 with respect to the enveloping length of the pinched ends 18 of the infrared bright radiator 10, limit sleeves 22, 26 or 28, respectively when pulled over contact pins 24 or 40 so as to likewise insure the maintenance of the desired distance A between the sleeve ends.

While the invention has been particularly shown and described with reference to preferred embodiments thereof, it will be understood by those skilled in the art that the foregoing and other changes in form and details may be made therein without departing from the spirit and scope of the invention.

What is claimed is:

1. In an infrared bright radiator having insulating sleeve members surrounding contact pin members at respective pinched ends of the radiator and wherein each sleeve member comprises a hollow cylinder having at least an even outer circumferential surface and being provided with two diametrically slits at the end facing away from the free end of the associated contact pin member, the improvement wherein each insulating sleeve member is formed of plastic material and wherein the surface of one of the contact of one of the contact pin or sleeve members facing the other is provided with a radial projection and the surface of the other contact pin or sleeve member facing that projection is provided with an annular recess receiving the projection an axially limiting movement of the contact pin and sleeve members with respect to each other.

2. The infrared bright radiator according to claim 1, wherein the inner surface of each cylindrical insulating sleeve member is provided with a radial projecting part which engages an annular groove on the periphery of the associated contact pin member.

3. The infrared bright radiator according to claim 2, wherein said radial projecting part comprises an annular bead.

4. The infrared bright radiator according to claim 2, wherein said radial projecting part comprises a transition from a cylindrical recess to a truncated cone-shaped recess with the diameter of the cylindrical recess at the transition point to the cone-shaped recess being greater than the diameter of the adjacent truncated cone-shaped recess.

5. The infrared bright radiator according to claim 4, wherein the truncated cone-shaped recess enlarged in the direction of the end face of the insulatng sleeve member which faces away from the free end of the contact pin member.

6. The infrared bright radiator according to claim 1, wherein each contact pin member is in the form of a thin disc acting as a radial projection and each sleeve member comprises an annular grove within its inner surface said contact pin member and receiving the edge of said disc.

7. The infrared bright radiator according to claim 1, wherein said slits within said sleeve members are of rectangular configuration and of a length corresponding to that of the individual pinched ends of the radiator such that in addition to engaging the contact pin members to firmly lock the contact pin members within the insulating sleeve members, the sleeve members correctly maintain the distance between the ends of the insulating sleeve members facing away from respective contact members.

8. The infrared right radiator according to claim 1 wherein each insulating sleeve member comprises a die-cast part of synthetic material having good electrical insulating properties and a small coefficient of expansion in the temperature range of room temperature to approximately 260° C.

9. The infrared bright radiator according to claim 8, wherein said synthetic material comprises a PFA-fluor synthetic material.

* * * * *